US008147289B1

(12) United States Patent
Lee

(10) Patent No.: US 8,147,289 B1
(45) Date of Patent: Apr. 3, 2012

(54) TOY HELICOPTER HAVING GUARDS FOR PREVENTING CONTACT OF THE VERTICAL LIFT ROTORS

(76) Inventor: Jason C. Lee, Princeton Junction, NJ (US)

( * ) Notice: Subject to any disclaimer, the term of this patent is extended or adjusted under 35 U.S.C. 154(b) by 114 days.

(21) Appl. No.: 12/436,284

(22) Filed: May 6, 2009

Related U.S. Application Data

(60) Provisional application No. 61/162,248, filed on Mar. 20, 2009.

(51) Int. Cl.
*A63H 27/127* (2006.01)

(52) U.S. Cl. ..... 446/36

(58) Field of Classification Search ..... 446/34, 446/36, 37, 38; 244/17.11, 17.23; 416/247 R
See application file for complete search history.

(56) References Cited

U.S. PATENT DOCUMENTS 1,735,675 A * 11/1929 Danckwart ..... 244/121
3,583,659 A * 6/1971 Lermusiaux ..... 244/17.19
6,086,016 A * 7/2000 Meek ..... 244/17.11
6,550,715 B1 * 4/2003 Reynolds et al. ..... 244/7 B
6,659,395 B2 * 12/2003 Rehkemper et al. ..... 244/17.11
7,204,453 B2 * 4/2007 Muren ..... 244/17.11
7,273,195 B1 * 9/2007 Golliher ..... 244/17.11
7,331,838 B2 * 2/2008 Shantz ..... 446/57
7,798,883 B2 * 9/2010 Elson et al. ..... 446/37
7,802,755 B2 * 9/2010 Poltorak ..... 244/17.27
2007/0215750 A1 * 9/2007 Shantz et al. ..... 244/17.23

* cited by examiner

*Primary Examiner* — Gene Kim
*Assistant Examiner* — Alyssa Hylinski
(74) *Attorney, Agent, or Firm* — LaMorte & Associates P.C.

(57) ABSTRACT

A toy helicopter assembly having a guard that prevents the vertical lift rotors of the toy helicopter from inadvertently contacting any object while spinning. The toy helicopter has a body that includes a fuselage and landing gear. A drive shaft extends upwardly from the fuselage. A least one rotor is connected to the driveshaft. Each rotor is rotated by the drive-shaft in a circular path through a predetermined plane of rotation. A plurality of loop structures are attached to the toy helicopter. The loop structures extend along curved paths, therein creating a guarded area within the curved paths. The loop structures are oriented so that at least part of the circular path that is traversed by the rotors extends through the guarded area.

10 Claims, 6 Drawing Sheets

TOY HELICOPTER HAVING GUARDS FOR PREVENTING CONTACT OF THE VERTICAL LIFT ROTORS

RELATED APPLICATION

This application is a continuation-in-part of U.S. Provisional Patent Application No. 61/162,248, filed Mar. 20, 2009 and entitled Toy Helicopter Protection And Self-Righting Device.

BACKGROUND OF THE INVENTION

1. Field of the Invention

In general, the present invention relates to toy helicopters and other flying toys that have a propeller mounted in the horizontal plane to provide vertical lift. More particularly, the present invention relates to guard configurations that are used to protect the propellers from incidental contact and contact damage.

2. Prior Art Description

Model helicopters have been in existence for over fifty years. In the beginning of this period, model helicopters required powerful gasoline engines and metal rotors in order to achieve lift. This made model helicopters expensive and highly dangerous. The spinning blades could cause serious bodily injury. Likewise, if the model helicopters crashed they nearly always were destroyed and required major repairs to fly again. Accordingly, model helicopters were used primarily by an exclusive group of adult hobbyists.

Over the years, improvements have been made in small electric motors, batteries and plastics to enable lightweight, low cost toy helicopters to be produced for the mass market. Toy helicopters are light enough to take flight with only low power motors. The low power motors ensure that rotors used by the toy helicopters would not cut or otherwise cause harm to a child who might touch the rotors of the toy helicopter when spinning.

Due to the improvements in both cost and safety, toy helicopters have become some of the most popular toys for children between the ages of eight and sixteen.

A problem associated with modern toy helicopters is that the rotors of the helicopters are made of very thin, lightweight plastic. Likewise the gimble joint that joins the vertical lift rotors to the helicopter are also made of lightweight plastic parts. As a consequence, when a toy helicopter crashes, it is not uncommon for the rotors and/or the gimble joint to break. The toy is then unable to fly until it is repaired.

As is often the case, toy helicopters tend to be operated by remote control. As such, a child has the ability to start and stop the rotation of the rotors by pressing various buttons on a remote control handset. If a toy helicopter is lying on its side or is otherwise not upright, the rotors of the toy helicopter will repeatedly strike the ground the moment the rotors are activated by remote control. This accidental activation often causes damage to the rotors and/or the gimble joint supporting the rotors.

The best way to prevent the rotors and/or the gimble joints of a toy helicopter from being damaged is to prevent the rotors from contacting any object at any time the rotors are spinning. This includes during take off, during flight, during controlled landings and during crash landings.

In the prior art, training kits are often sold with toy helicopters. The training kits typically include guards that attach to the base of the helicopter and extend outwardly to a distance further than the helicopter blades. In this manner, if a helicopter is flown too close to a wall or similar vertical obstacle, the guard would act as a bumper and would contact the obstacle before the spinning rotor. In this way, a crash could be avoided. The problem with training kits is obvious. Training kits only prevent accidental contact with an object that approaches the helicopter from the front or side. The training kit does nothing to prevent the helicopter from rising up and striking the ceiling, a lamp or a tree branch. Furthermore, the training kit does nothing to protect the rotors if the toy helicopter crashes into the ground upside down or flipped upon contact with the ground. Likewise, such training kits do not protect a toy helicopter if its rotors are started by remote control when the helicopter is on its side or leaning against another object.

A need therefore exists for a toy helicopter with a guard configuration that prevents the rotors of the helicopter from contacting any obstacles during take off, flight and even crash landings. A need also exists for a toy helicopter with a guard configuration that prevents the rotors from contacting an object should the helicopter not be upright when activated. Lastly, a need exists for a toy helicopter with a guard configuration that does not impede the flight characteristics of the toy helicopter. These needs are met by the present invention as described and claimed below.

SUMMARY OF THE INVENTION

The present invention is a toy helicopter assembly having a guard that prevents the vertical lift rotors of the toy helicopter from inadvertently contacting any object while spinning.

The toy helicopter has a body that includes a fuselage and landing gear. A drive shaft extends upwardly from the fuselage. The drive shaft is turned by a motor held inside the fuselage. A least one rotor is connected to the driveshaft. Each rotor is rotated by the driveshaft in a circular path through a predetermined plane of rotation. A plurality of loop structures are attached to the toy helicopter. The loop structures extend along curved paths, therein creating a guarded area within the curved paths. The loop structures are oriented so that at least part of the circular path that is traversed by the rotors extends through the guarded area.

The loop structures prevent the rotors from touching most objects the toy helicopter may fly into. The loop structures also help orient the helicopter into its upright position when the toy helicopter contacts the ground.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy helicopter and guard system can be embodied in many ways, the embodiments illustrated show the guard system applied to a toy helicopter having a single set of vertical lift rotors. This embodiment has been selected for its simplicity. It will be understood that toy helicopter designs exist that have multiple sets of vertical lift rotors. The described guard system can also be applied to such alternate designs. It will therefore be understood that the illustrated embodiments are merely exemplary and should not be considered limitations when interpreting the scope of the appended claims.

Figure 1:
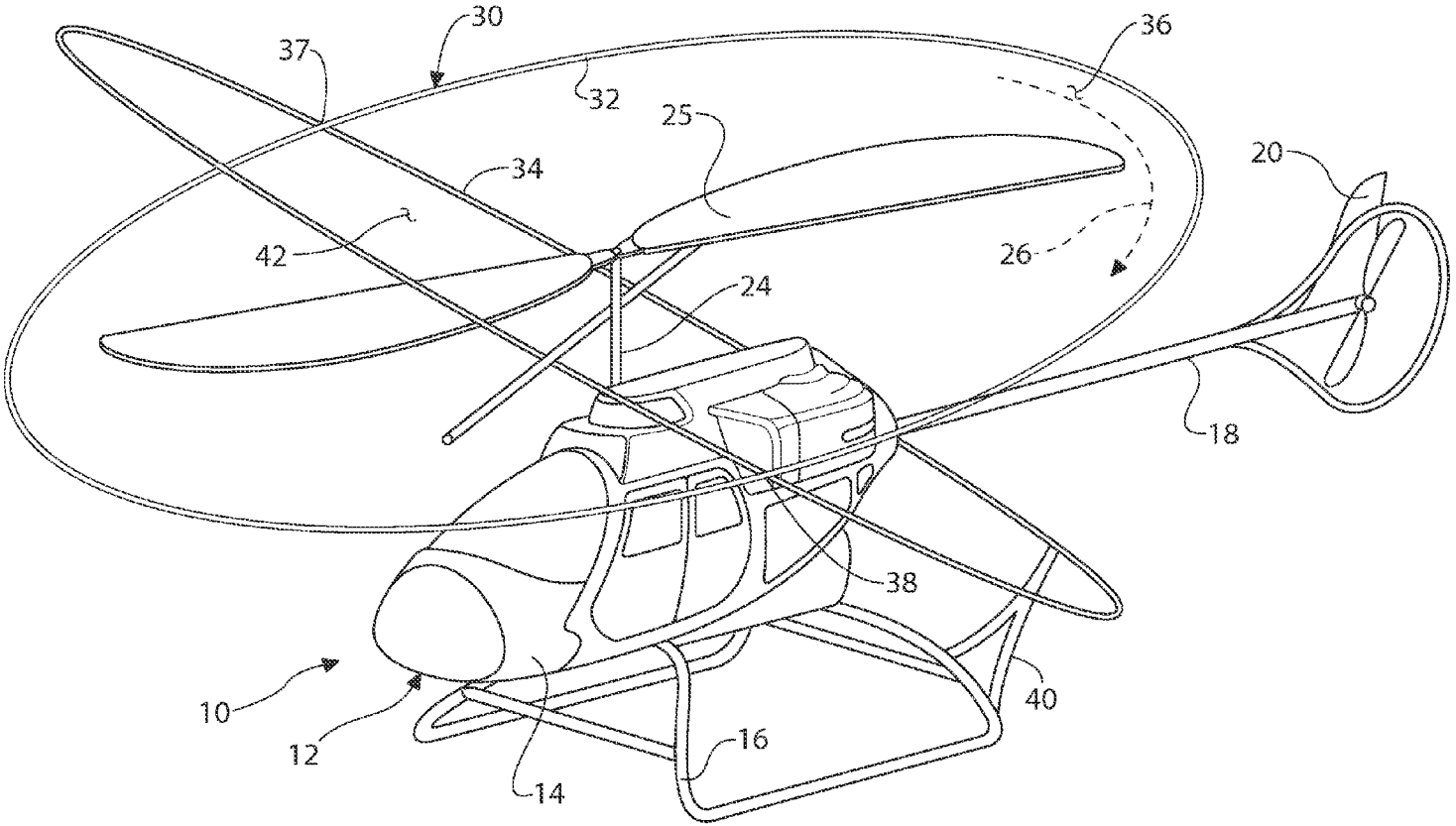
FIG. 1 is a perspective view of an exemplary embodiment of a toy helicopter assembly.
Figure 2:
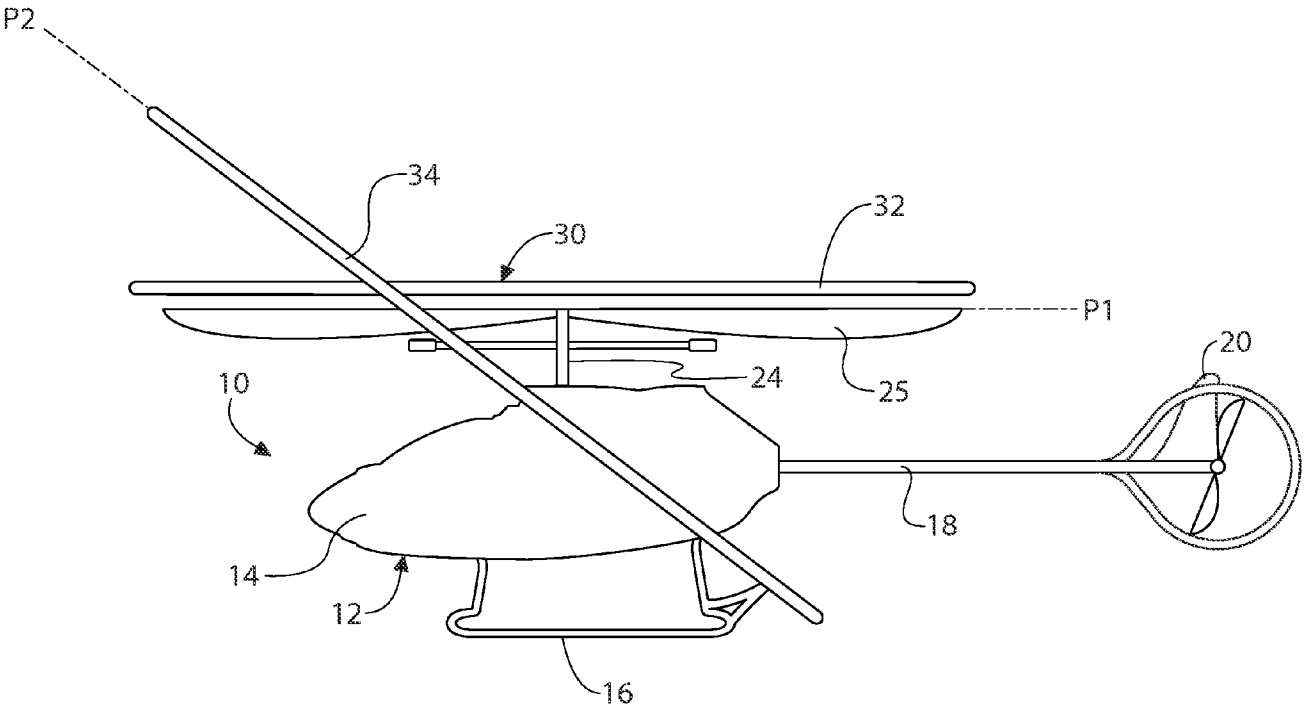
FIG. 2 is a side view of the exemplary embodiment shown in FIG. 1.

Referring to FIG. 1 and FIG. 2, a toy helicopter 10 is illustrated. The toy helicopter 10 has a body 12 consisting of lightweight fuselage 14 and landing gear 16. The landing gear 16 extends below the fuselage 14. The landing gear 16 supports the toy helicopter 10 in an upright position when the toy helicopter 10 is at rest on the ground.

The fuselage 14 contains a tail extension 18 that supports at least one stabilization fin 20. A tail rotor 22 may or may not be present on the tail, depending upon the design type of the toy helicopter 10 being used. The motor, battery and electronic controls needed to power and control the toy helicopter 10 are contained within the fuselage 14 and are not shown.

A drive shaft 24 extends upwardly out of the top of the fuselage 14. The drive shaft 24 is connected to the motor contained inside the fuselage 14. At least one vertical lift rotor 25 is connected to the drive shaft 24, wherein the driveshaft 24 rotates the vertical lift rotors 25. The vertical lift rotors 25 rotate in a plane of rotation P1. The vertical lift rotors 25 also rotate in a circular path 26 having a predetermined spin diameter.

A guard assembly 30 is provided. The guard assembly 30 contains at least two wire loop structures 32, 34. The first wire loop structure is a horizontal wire loop structure 32. The horizontal wire loop structure 32 extends around the circular path 26 of the vertical lift rotors 25. Preferably, the horizontal wire loop structure 32 lies in the same plane as the plane of rotation P1 of the vertical lift rotors 25. However, the plane of the horizontal wire loop structure 32 can lay parallel to the plane of rotation P1 either slightly above or slightly below the vertical lift rotors 25.

The horizontal wire loop structure 32 defines an interior area 36 that is larger than the spin diameter of the vertical lift rotors 25. It will therefore be understood that the vertical lift rotors 25 can spin freely within the confines of the horizontal wire loop structure 32.

The horizontal wire loop structure 32 is held in place, at least in part, by an oblique wire loop structure 34. The oblique wire loop structure 34 is a wire loop structure that intersects the horizontal wire loop structure 32 at two intersection points 37, 38 on opposite sides of the horizontal wire loop structure 32. Preferably, the intersection points 37, 38 are to the left and right of the helicopter fuselage 14. The oblique wire loop structure 34 extends in a plane P2 that is oblique to the plane of rotation P1 for the vertical lift rotors 25 and the corresponding plane of the horizontal wire loop structure 32. Preferably, the oblique wire loop structure 34 is positioned in an oblique plane that intersects the plane of rotation P1 between a thirty-degree and a sixty-degree angle.

The oblique wire loop structure 34 is curved. The oblique wire loop structure 34 is preferably circular, however, oblong curves may also be used. In the exemplary embodiment, the oblique wire loop structure 34 is circular and has a diameter equal to that of the horizontal wire loop structure 32. The oblique wire loop structure 34 is anchored directly to the helicopter fuselage 14 and/or the helicopter landing gear 16. If the oblique wire loop structure 34 does not directly intersect the helicopter fuselage 14 or landing gear 16, anchor supports 40 can be provided that help hold the oblique wire loop structure 34 firmly in place.

Both the horizontal wire loop structure 32 and the oblique wire loop structure 34 are preferably made of a lightweight strand of semi-flexible plastic. The term "wire" is just to imply the loop structure is made of a thin strand of strong material that is capable of supporting its own weight and protecting the vertical lift rotors 25. However, other material, such as spring wire can also be used in place of plastic. The horizontal wire loop structure 32 and the oblique wire loop structure 34 are kept thin so these elements do not significantly detract from the aerodynamics of the toy helicopter 10 during flight.

The horizontal wire loop structure 32 and the oblique wire loop structure 34 define peripheral paths along the exterior of a common guarded area 42. The vertical lift rotors 25 are positioned within this guarded area 42 and rotate through their circular path 26 while remaining within this guarded area 42.

Figure 3:
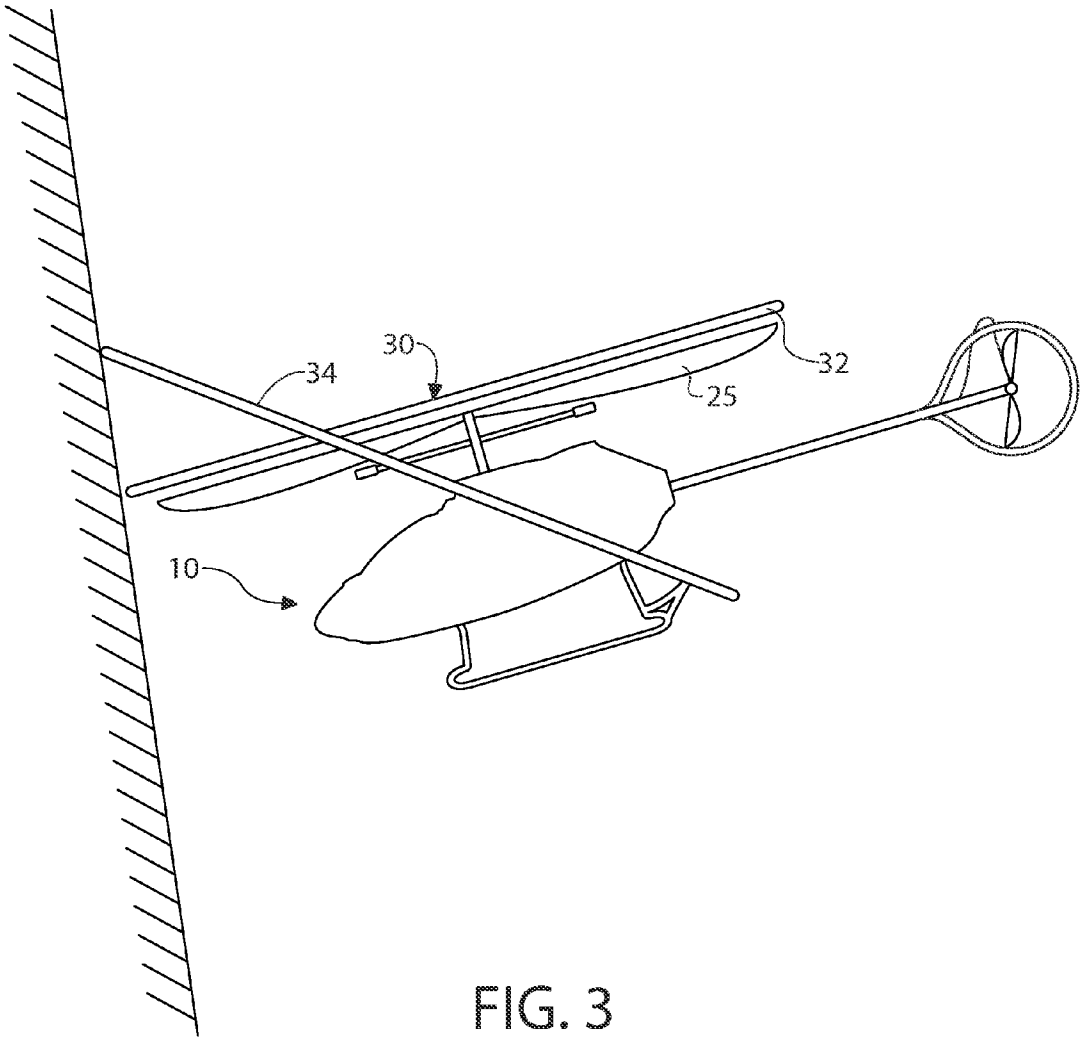
FIG. 3 is a side view showing the exemplary embodiment in flight and contacting a vertical wall.
Figure 4:
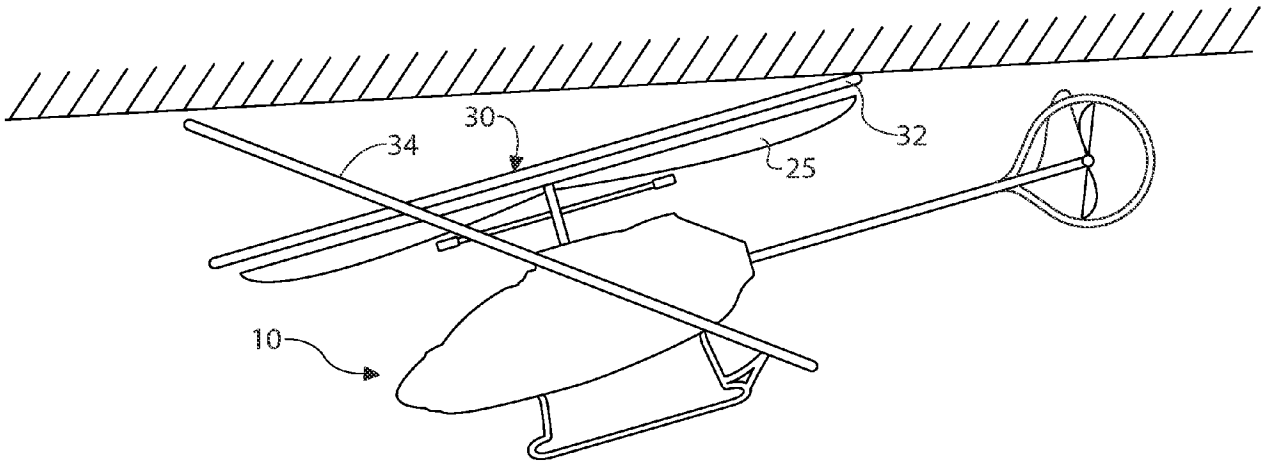
FIG. 4 is a side view showing the exemplary embodiment in flight and contacting a horizontal ceiling.

Referring to FIG. 3 and FIG. 4, it can be seen that both the horizontal wire loop structure 32 and the oblique wire loop structure 34 present physical barriers that protect the vertical lift rotors 25 from incidental contact within the guarded area 42. The horizontal wire loop structure 32 presents the most forward part of the overall assembly. The oblique wire loop structure 34 presents the highest part of the overall assembly as well as the left-most and right-most parts of the assembly. The horizontal wire loop structure 32 prevents the vertical lift rotors 25 from contacting any item, such as a wall, that approaches the rotor near its plane of rotation. The oblique wire loop structure 34 prevents the vertical lift rotors 25 from contacting any item, such as a ceiling, that the toy helicopter 10 may approach while ascending. By preventing the vertical lift rotors 25 from being contacted, the toy helicopter 10 can continue to fly and remain in control, even through it was flown directly into a wall or ceiling. This prevents the most common causes of crash landings and damage to the toy helicopter 10.

Figure 5:
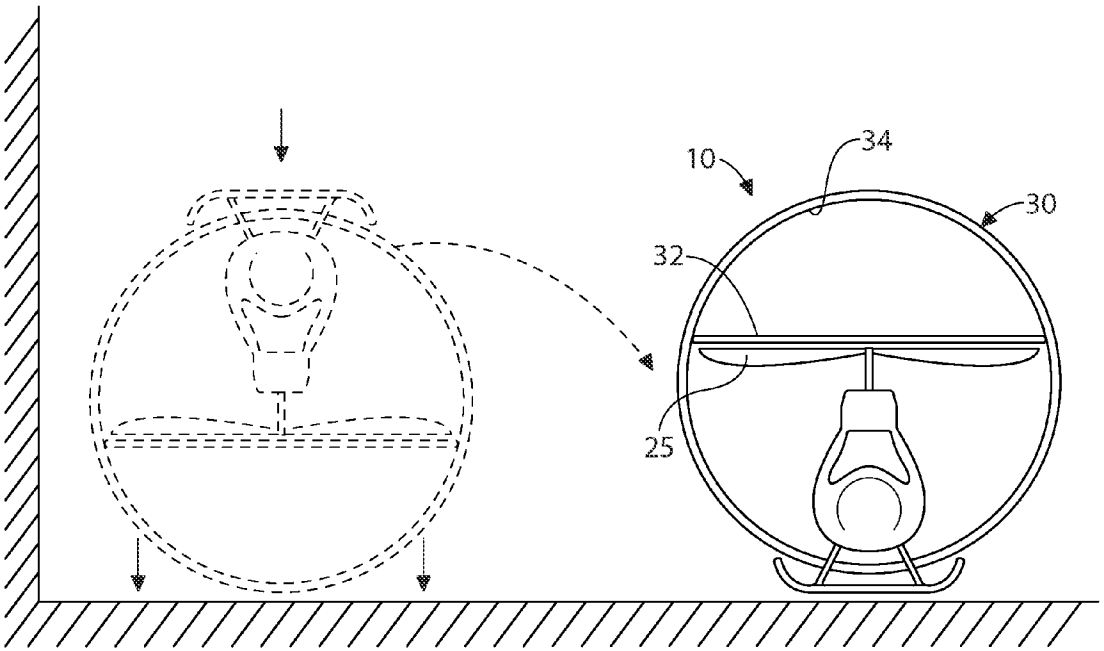
FIG. 5 is a front view showing the exemplary embodiment in a crash landing and contacting a ground surface.

In addition to preventing incidental contact during flight, the guard assembly 30 also protects the toy helicopter 10 in both controlled landings and crash landings. Referring to FIG. 5, it can be seen that if the toy helicopter 10 approaches the ground with its rotors 25 out of the horizontal plane, the oblique wire loop structure 34 and/or the horizontal wire loop structure 32 will prevent the rotors 25 from contacting the ground and becoming damaged. Furthermore, the weight of the toy helicopter 10 is not centered in either the horizontal wire loop structure 32 or the oblique wire loop structure 34. Consequently, should the horizontal wire loop structure 32 or the oblique wire loop structure 34 come into contact with the ground, the weight of the toy helicopter 10 will cause the entire assembly to roll until the toy helicopter 10 comes to rest in an upright position. Even if the toy helicopter 10 were to crash land completely upside down, the toy helicopter 10 would roll into an upright position without anything contacting the vertical lift rotors 25.

Additionally, many prior art toy helicopters are damaged by accidentally activating the rotors while the helicopter is lying on its side or in contact with some other obstruction. In the present invention, the guard assembly 30 prevents objects from contacting the vertical lift rotors 25 even if the toy helicopter 10 is pinned in a tilted orientation amongst a child's collection of toys.

Figure 6:
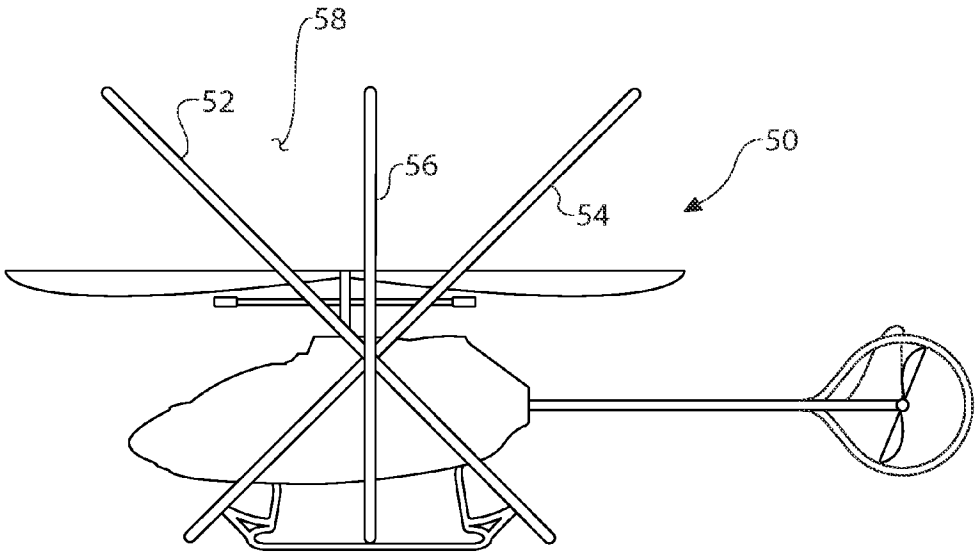
FIG. 6 is a side view of an alternate embodiment of the present invention.

Referring to FIG. 6, an alternate embodiment of the present invention toy helicopter 50 is shown. In this embodiment, the toy helicopter 50 has many of the same features as the previous embodiment. Accordingly, the same numbers will be used for reference of the same features to avoid confusion. In this embodiment, the guard assembly no longer has a horizontal wire loop structure, but is rather configured from two oblique wire loop structures 52, 54 and one vertical wire loop structure 56.

As with the first embodiment, the two oblique wire loop structures 52, 54 and the one vertical wire loop structure 56 define paths along the exterior of a guarded area 58. The wire loop structures 52, 54, 56 represent the surfaces farthest in the front, farthest to the sides and farthest atop the overall assembly. Accordingly, should the toy helicopter 10 approach any large object, such as a wall or ceiling, then one of the wire loop structures 52, 54, 56 will be the first surface to make contact. This protects the spinning vertical lift rotors 25 from contact.

In the embodiment of FIG. 6, it can be seen that the two oblique wire loop structures 52, 54 and the vertical wire loop structure 56 are all curved. As such, it will be understood that if the toy helicopter 50 were to land on its side or even upside down, the toy helicopter 50 would roll on the wire loop structures 52, 54, 56 and quickly become upright without anything contacting the vertical lift rotors 25.

It will be understood that the embodiments of the present invention that are illustrated and described are merely exemplary and that a person skilled in the art can make many variations to those embodiments. For instance, in the first embodiment, two loop structures are used. In the second embodiment, three loop structures are used. It should be understood that any plurality of loop structures can be used. A minimal number is preferred to reduce weight and to minimize aerodynamic drag. Furthermore, in the first embodiment, a horizontal loop structure is used. In the second embodiment, a vertical loop structure is used. In both embodiments, oblique loop structures are used. It will be understood that any plurality of loop structures can be used in any orientation, provided that the loop structures define a guarded area in which the vertical lift rotors of the toy helicopter can operate.

In all exemplary embodiments, the loop structures are uniformly curved, it will be understood that this need not be. The looped structures can have flat sections or may even be shaped as a polygon, provided the overall path followed by the loop structures is curved about the guarded area in which the vertical lift rotors operate. All such embodiments are intended to be included within the scope of the present invention as defined by the claims.

What is claimed is:

1. A toy helicopter assembly, comprising:

a helicopter body that includes a fuselage and landing gear;

a drive shaft extending upwardly from said fuselage;

a tail section extending from said fuselage;

lift rotors that are rotated by said drive shaft in a circular path through a plane of rotation;

an oblique guard loop coupled to said helicopter body, said oblique guard loop being offset from said plane of rotation by an angle of between thirty degrees and sixty degrees, wherein said circular path of said lift rotors partially extends through said oblique guard loop; and a horizontal guard loop supported in a plane parallel to said plane of rotation by said oblique guard loop, therein creating a guarded area within said oblique guard loop and said horizontal guard loop, wherein at least part of said circular path traversed by said lift rotors extends through said guarded area.

2. The assembly according to claim 1, wherein said oblique guard loop follows a circular path.

3. The assembly according to claim 1, wherein said tail section extends beyond said guarded area defined by said oblique guard loop and said horizontal guard loop.

4. The assembly according to claim 1, wherein said horizontal guard loop surrounds said circular path of said lift rotors.

5. The assembly according to claim 1, wherein said horizontal guard loop is position slightly above said circular path of said lift rotors.

6. A toy helicopter assembly, comprising:

a fuselage having an upright position;

lift rotors that spin in a circular path through a plane of rotation, wherein said circular path is elevated above said fuselage when said fuselage is in said upright position;

an oblique guard loop supported by said fuselage, said oblique guard loop being offset from said plane of rotation by an angle of between thirty degrees and sixty degrees, wherein said circular path of said lift rotors partially extends through said oblique guard loop, and a horizontal guard loop supported in a plane parallel to said plane of rotation by said oblique guard loop, therein creating a guarded area within said oblique guard loop and said horizontal guard loop, wherein at least part of said circular path traversed by said lift rotors extends through said guarded area wherein said oblique guard loop causes said fuselage to roll into said upright position when said oblique guard loop contacts a ground surface.

7. The assembly according to claim 6, wherein a tail section extends beyond said guarded area defined by said oblique guard loop and said horizontal guard loop.

8. The assembly according to claim 6, wherein said horizontal guard loop surrounds said circular path of said lift rotors.

9. The assembly according to claim 6, wherein said horizontal guard loop is position slightly above said circular path of said lift rotors.

10. A method of protecting the vertical lift rotors of a toy helicopter from incidental contact, said method comprising the steps of:

providing a toy helicopter having a helicopter body, a tail section extending laterally from said helicopter body and lift rotors positioned above said helicopter body that rotate in a circular path through a plane of rotation;

extending an oblique guard loop from said helicopter body, wherein said oblique guard loop is offset from said plane of rotation by an acute angle, and wherein said circular path of said lift rotors partially extends through said oblique guard loop; and providing a horizontal guard loop supported in a plane parallel to said plane of rotation by said oblique guard loop, therein creating a guarded area within said oblique guard loop and said horizontal guard loop, wherein at least part of said circular path traversed by said lift rotors extends through said guarded area.

* * * * *